United States Patent [19]

Jenkins

[11] Patent Number: 4,484,367

[45] Date of Patent: Nov. 27, 1984

[54] NURSE CALL APPARATUS

[76] Inventor: Betty S. Jenkins, Rte. 14, Box 67, Gray, Tenn. 37615

[21] Appl. No.: 483,846

[22] Filed: Apr. 8, 1983

[51] Int. Cl.[3] ..... A47C 21/08; A47C 19/02

[52] U.S. Cl. ..... 5/425; 2/DIG. 6; 5/503; 5/508

[58] Field of Search ..... 5/503, 425, 424, 482, 5/485; 248/205 R, 205.1, 214; 224/901, 911; 24/306, 307, 185, 265 AL; 2/DIG. 6, 311, 312, 237, 247, 250

[56] References Cited

U.S. PATENT DOCUMENTS

| | | | |
|---|---|---|---|
| 1,686,002 | 10/1928 | Herzon | 5/503 |
| 1,698,085 | 1/1929 | Crozier | 54/503 |
| 1,936,045 | 11/1933 | Bachrach | 2/247 |
| 3,279,008 | 10/1966 | Wallach | 24/306 |
| 3,849,629 | 11/1974 | Graham | 248/205 R |
| 3,947,927 | 4/1976 | Rosenthal | 24/306 |
| 4,029,243 | 6/1977 | Zerobnick et al. | 224/901 |
| 4,057,181 | 11/1977 | Finnigan | 224/911 |
| 4,119,249 | 10/1978 | Hanson | 224/901 |
| 4,220,302 | 9/1980 | Hampton et al. | 248/205 R |
| 4,235,350 | 11/1980 | Valentino | 248/205 R |

*Primary Examiner*—Alexander Grosz
*Assistant Examiner*—Vinh Luong
*Attorney, Agent, or Firm*—Wenderoth, Lind & Ponack

[57] ABSTRACT

A nurse call apparatus includes a nurse call device, a bed having a side railing and a flexible sheet and a pocket, formed on one side of the flexible sheet for receiving the call device. The holder can be wrapped about the horizontal bars of the bed railing so that the pocket faces the bed proper. In one embodiment of the invention, a D-ring and self-adhering adhesive are respectively provided at opposite ends of the sheet for use in maintaining the holder wrapped about the bed railing. In an alternative embodiment, textile fastening strips, are provided at opposite ends of the sheet to keep the holder wrapped around the bed railing.

12 Claims, 5 Drawing Figures

NURSE CALL APPARATUS

FIELD OF THE INVENTION

The present invention relates to hospital bed accessories and more particularly to a holder for a nurse call device which may be fastened to a hospital bed railing.

BACKGROUND OF THE INVENTION

Nurse call devices are an almost essential fixture in today'hospitals. Such devices are repeatedly utilized, often several times each day, by many hospital patients and can be an essential means of notifying hospital personnel that a patient is in great need of assistance. Ordinarily, such devices are connected by an electrical cable to a wall. Ordinarily, such devices are hung from the bed post or headboard, or simply lay freely on the bed or on a counter. However, when left in these positions they are often knocked to the floor or lost in the patient's sheets and blankets, and difficult for the patient to reach or even find when needed. Particularly when a patient is confused, panicked, weak, in pain, lacking normal coordination or sight, or in conditions or poor visibility, the patient may have great difficulty in obtaining and utilizing the nurse call device.

One solution to this problem has been proposed in U.S. Pat. No. 2,876,464, issued to H. Helverson on Mar. 10, 1959. The Helverson patent discloses a hospital bed bell cord anchor consisting of a pocket permanently stitched flat onto a hospital bed sheet. This anchor has several difficulties in use. Firstly, the bell cord can be accidently dislodged by the patient from the anchor and fall to the floor. The patient can roll over onto the bell cord causing the patient discomfort. Depending on the patient's preferred lying position, the bell cord may be difficult to grasp or remove from the anchor.

The Helverson anchor also has a number of cost disadvantages. Since the anchor is sewn to a bed sheet, it would likely be necessary to replace the entire bed sheet if the anchor should become torn. If such anchors are desired on all or most beds in a particular facility, sheets not having the anchor would become obsolete, or anchors would have to be specially sewn onto each sheet at great cost.

OBJECTS AND SUMMARY OF THE INVENTION

It is therefore an object of the invention to provide a holder for a nurse call device which holds the device at a location where it can be utilized by the patient without moving or holding it, from which it is convenient for the patient to remove the same, in which it is convenient for the patient to replace the device after use, in which the device will not interfere with the patient's comfort or movement, and from which the device is not easily accidently dislodged.

It is also an object of the invention to provide such a holder which is inexpensive to produce on a mass scale, is adaptable to inexpensive "disposable" construction, is not permanently attached to any other hospital room fixture, and is easily fastened to the bed or removed for cleaning or to be thrown away and replaced.

These objects are met by the nurse call device holder of the present invention. In accordance with one aspect of the invention, there is provided a nurse call device holder which includes a flexible sheet and a pocket formed on one side of the flexible sheet for receiving the call device, and which can be wrapped about the horizontal bars of a side bed railing so that the pocket faces the bed proper. In one embodiment of the invention, a D-ring and self-adhering adhesive are respectively provided at opposite ends of the sheet for use in maintaining the holder wrapped about the bed railing. In an alternative embodiment, textile fastening strips such as the strips sold under the trademark "Velcro" are provided at opposite ends of the sheet to keep the holder wrapped around the bed railing.

In a reusable embodiment, the holder is formed of cloth. In a disposable embodiment, the holder may be formed of paper.

BRIEF DESCRIPTION OF THE DRAWINGS

Various aspects of the invention will be better understood from the following detailed description of the preferred embodiments with reference to the accompanying drawings in which.

DETAILED DESCRIPTION OF THE PREFERRED EMBODIMENTS

Figure 1:
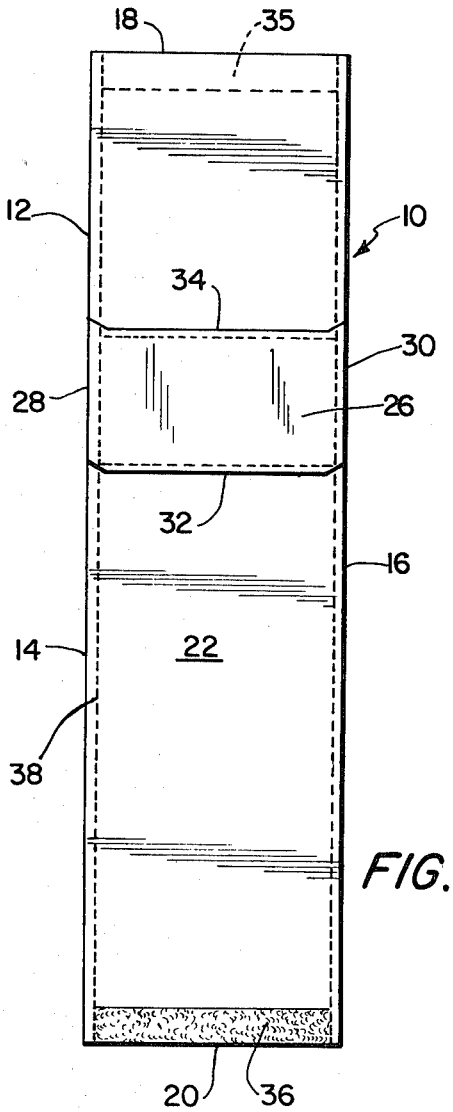
FIG. 1 is a plan view of a first embodiment of the nurse call holder in accordance with the present invention.
Figure 2:
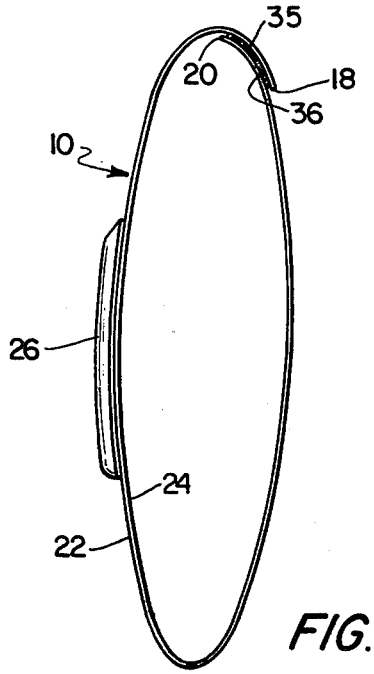
FIG. 2 is a side view of the nurse call holder illustrated in FIG. 1, with opposite ends fastened together.
Figure 3:
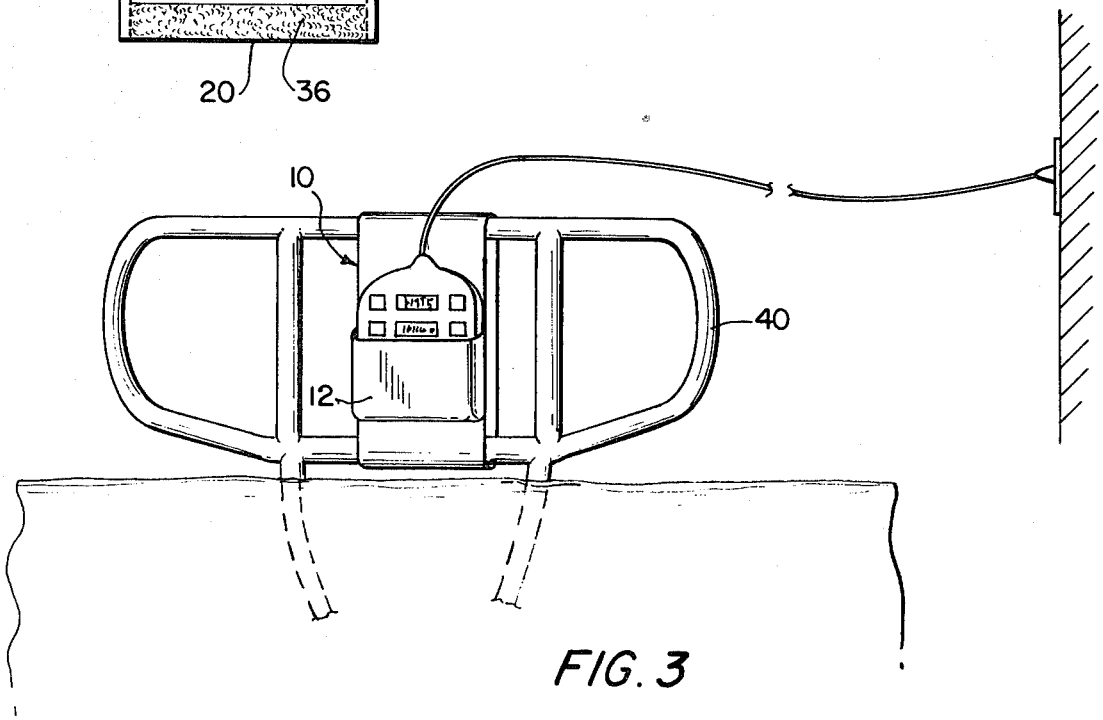
FIG. 3 is a perspective view of the present invention in use on a hospital bed.

Referring to FIG. 1 and FIG. 2, a holder 10 for a nurse call device in accordance with the first embodiment of the invention includes a flexible sheet 12 of sufficient length to completely wrap around a side railing of a hospital bed as is illustrated in FIG. 3, sheet 12 having parallel side edges 14 and 16, a top edge 18 and a bottom edge 20, a front face 22 and a rear face 24. A pocket 26 having side edges 28 and 30, a bottom edge 32 and a top edge 34 is fixed to the front face 22 of flexible sheet 12 with bottom edge 32 of pocket 26 parallel to the top edge 18 of the flexible sheet 12. Pocket 26 is of substantially the same width as the flexible sheet 12. Edges 28 and 30 of pocket 26 are respectively fixed to side edges 14 and 16 of flexible sheet 12. Pocket 26 is open along edge 34 and closed to flexible sheet 12 along bottom edge 32.

Pocket 26 and flexible sheet 12 are suitably constructed from cloth, plastic, or paper. If formed from cloth, pocket 26 may be fixed to flexible sheet 12 by machine stitching. If pocket 26 and flexible sheet 12 are formed from plastic, they may be fixed to one another by heat sealing along edges 28, 30, and 32. An adhesive may be used to fasten the pocket 26 to flexible sheet 12 if the parts are formed from paper. Other suitable means for fixing a pocket to a flexible sheet may be utilized.

Means for fastening the holder 10 to a hospital bed railing are provided at edges 18 and 20. In accordance with the embodiment illustrated in FIG. 1, such fastening means consists of self-adhering textile strips 35 and 36, such as those known by the trademark "Velcro", respectively extending along top edge 18 on rear face 24 and bottom edge 20 on front face 22. Textile fastening strips 35 and 36 are suitably sewn onto the flexible sheet 12.

In order to improve the strength and wear properties of a holder, the edges thereof are hemmed along hem-lines 38.

In use, the holder 10 is wrapped vertically around the spaced horizontally extending bars of a hospital railing 40 with pocket 26 facing the bed as illustrated in FIG. 3, such that the textile fastening strips 35 and 36 oppose each other and can be pressed together to removably fasten the holder in place. A nurse call device 42 is then placed in pocket 26 as illustrated.

It has been found that hospital bed railings can vary substantially in height. In order that the present invention may be utilized on all such railings, the width of at least one of the textile strips can be substantially increased. Alternatively, the fastening means in accordance with the second embodiment of the invention as illustrated in FIGS. 4 and 5 may be utilized.

Figure 4:
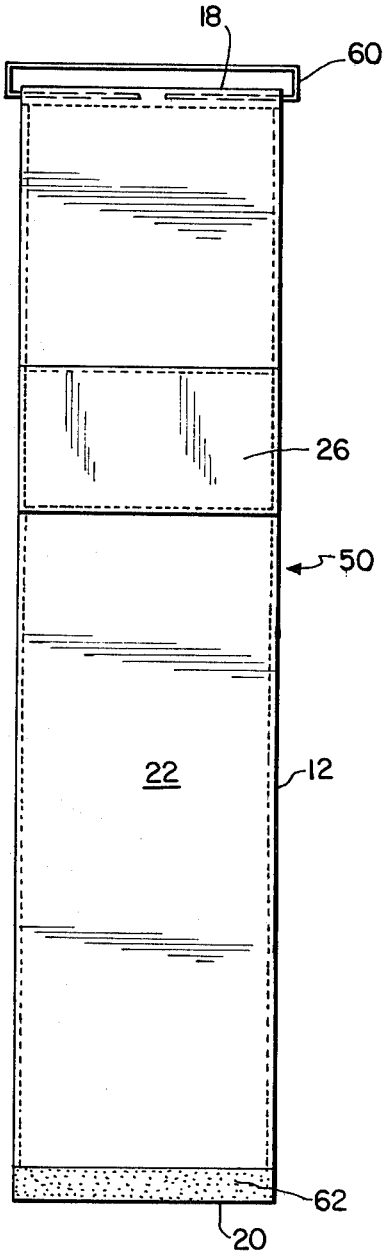
FIG. 4 is a plan view of a second embodiment of the nurse holder in accordance with the present invention.
Figure 5:
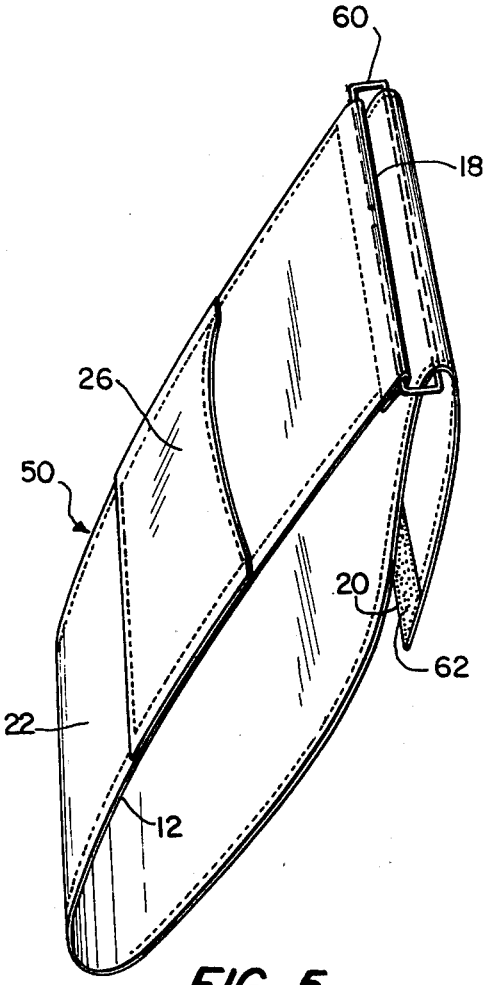
FIG. 5 is a perspective view of the nurse call holder illustrated in FIG. 4 in an orientation which illustrates the manner of fixing the holder to a hospital bed rail.

In order to make the holder adaptable to use with railings of various heights, an alternate fastening means such as is shown in the embodiment illustrated in FIGS. 4 and 5 can be utilized. Referring to FIG. 4, the fastening means includes a D-ring 60 fixed to the top edge 18 of flexible sheet 12 and an adhesive strip 62 provided on the front face 22 along the bottom edge 20 of flexible sheet 12.

In use, the holder 50 is wrapped around the hospital bed railing and the bottom end of the flexible sheet 12 is pulled through D-ring 60 as is illustrated in FIG. 5, and tightly pulled about the railing. The bottom edge 20 is then pressed against the front face 22 of the flexible sheet 12 so that the adhesive 62 adheres to front face 22 to secure the holder 50 to the railing.

The present invention may be of a relatively permanent construction, as for example, if manufactured from cloth. Since the holder is easily fastened to or moved from the railing, it may be periodically washed and put back in place. Alternatively, the holder can be a paper or plastic product which is inexpensively produced and can be disposed of and replaced after a single use.

In order to prevent possible slippage of either embodiment of the holder along or around the railing 40, an adhesive substance or adhesive tape can be applied to the rear surface 24 where the holder contacts the railing 40.

While particular embodiments of the present invention have been illustrated and described, it will be obvious to those skilled in the art that various changes and modifications can be made without departing from the spirit and scope of the invention and it is intended to cover, in the independent claims, all such modifications that are within the scope of the invention. Moreover, while the present invention has been described in the context of holding a nurse call device, it is not intended to thereby limit the present invention.

What is claimed is:

1. A nurse call apparatus comprising:

a bed;

a side railing fixed to a side of said bed;

a nurse call device; and a nurse call holder, said nurse call holder including an elongated flexible sheet having a first face and a second face opposite said first face, each bounded by opposite first and second longitudinal side edges and opposite first and second transverse side edges connecting opposite ends of said first and second longitudinal side edges; a pocket formed on said first side face removably receiving said nurse call device therein, said flexible sheet being wrapped about said side railing with said pocket exposed and facing said bed and each of said first and second longitudinal side edges extending around said side railing; and means, located along said first and second transverse side edges, for fastening said flexible sheet wrapped about said side railing with said transverse side edges in horizontal confronting relation to each other.

2. An apparatus as in claim 1, wherein said means comprises removably adhering textile strips formed on said first and second side faces at said first and second transverse side edges.

3. An apparatus as in claim 1, wherein said pocket has an open edge extending parallel said first transverse side edge.

4. An apparatus as in claim 2, wherein said flexible sheet is rectangular and said open edge extends substantially the full length of said first transverse side edge.

5. An apparatus as in claim 1, wherein said means comprises a loop extending along said first transverse side edge, said flexible sheet being removably extended, said second transverse side edge first, through said loop; and a self-adhering adhesive formed at said second transverse side edge on said first side face so as to be self-adhering to said first side face between said pocket and said second transverse side edge.

6. An apparatus as in claim 1, wherein said pocket is sewn to said flexible sheet.

7. An apparatus as in claim 1, wherein said pocket and said flexible sheet are formed of paper.

8. An apparatus as in claim 1, wherein said pocket and said flexible sheet are formed of plastic.

9. An apparatus as in claim 8, wherein said pocket is heat sealed to said flexible sheet.

10. An apparatus as in claim 1, wherein said pocket and said flexible sheet are formed of cloth.

11. An apparatus as in claim 1, wherein said pocket is flexible.

12. An apparatus as in claim 1, wherein said flexible sheet is rectangularly shaped.

* * * * *